US006205946B1

(12) United States Patent
Picton

(10) Patent No.: US 6,205,946 B1
(45) Date of Patent: Mar. 27, 2001

(54) EARTHEN MATERIAL INTEGRITY SENSING DEVICE

(76) Inventor: Daniel R. Picton, 3075 E. Rivercrest Dr., Post Falls, ID (US) 83854

( * ) Notice: Subject to any disclaimer, the term of this patent is extended or adjusted under 35 U.S.C. 154(b) by 0 days.

(21) Appl. No.: 09/078,305

(22) Filed: May 13, 1998

(51) Int. Cl.[7] ..... G01V 9/00

(52) U.S. Cl. ..... 116/215; 116/228; 33/1 H; 33/1 Q

(58) Field of Search ..... 116/215, 281, 116/283, DIG. 1, DIG. 16, 201, 228; 33/1 H, 1 Q, 719, 521; 73/784, 307, 305, 308, 322, 319, 321, 309, 315; 340/623, 624

(56) References Cited

U.S. PATENT DOCUMENTS

| | | | | |
|---|---|---|---|---|
| 500,013 | * | 6/1893 | Kwiatkowski | 116/281 |
| 1,170,290 | * | 2/1916 | Lindsay | 73/322 |
| 2,006,616 | * | 7/1935 | Adams | 73/315 |
| 2,269,189 | * | 9/1942 | Rudolf | 73/321 |
| 2,504,288 | * | 4/1950 | Wardell | 73/322 |
| 2,939,419 | * | 6/1960 | Hawkins | 116/288 |
| 3,992,927 | | 11/1976 | Troeh . | |
| 4,058,079 | * | 11/1977 | Taylor et al. | 116/283 |
| 4,255,859 | * | 3/1981 | Klieman | 73/321 |
| 5,533,392 | * | 7/1996 | Kira | 73/321 |

* cited by examiner

*Primary Examiner*—Andrew H. Hirshfeld
(74) *Attorney, Agent, or Firm*—Wells, St. John, Roberts, Gregory & Matkin, P.S.

(57) ABSTRACT

A sensing device and sensing process is described for indicating movement of earthen material adjacent a structure. The preferred device includes a tubular frame including a top end and a bottom end. An anchor is configured to suspend the frame from the structure with the bottom end oriented toward the earthen materials. An actuator is releasably mounted on the bottom end of the tubular frame, spanning the bottom end and configured to rest against and be supported by the earthen materials. The actuator is movable in response to movement of the earthen material relative to the structure from an inoperative position engaging and spanning the bottom end of the tubular frame to an operative position spaced from the inoperative position. A signaling device is mounted within the tubular frame and connected to the actuator. The process includes the step of attaching an anchor to the structure, and supporting the sensing device from the anchor with the actuator being movable between an inoperative position and an operative position in response to movement of the earthen material relative to the structure. The signaling device responds to movement of the actuator to the operative position to produce a signal indicating movement of the earthen material relative to the structure.

18 Claims, 9 Drawing Sheets

EARTHEN MATERIAL INTEGRITY SENSING DEVICE

TECHNICAL FIELD

The present invention relates to sensing erosion or shifting of particulate materials, especially earthen materials with respect to a structure, especially a roadway surface, railway tracks, foundation members or the like.

BACKGROUND OF THE INVENTION

Erosion, washouts, landslides, surface buckling and other natural and man-made events are responsible for huge amounts of property damage, injury and loss of life.

As an example, movement of railway ballast with respect to adjacent tracks can easily result in derailment of a train. Such movement may go undetected until it is too late. To the inventor's knowledge there has been no device developed that will provide adequate warning that such a situation has occurred. In fact the only way presently known for early detection of ballast erosion or track movement such as "sun kinks" is periodic visual track inspection. Railroads have recognized the problem and do make such inspections, but even with nearly daily inspection, events can and do occur which can cause derailment.

Similar problems can occur with paved and unpaved roadways, bridges, and in nearly any situation where a structure needs to remain substantially stationary relative to ground that has any capability of shifting.

A long felt need has thus existed for some system by which shifting of earthen material may be detected relative to an adjacent structure supported by the earthen material.

An object of the present invention is therefore to provide a sensing device for indicating movement of earthen material adjacent a substantially stationary structure.

The above and further objects and advantages of the present invention will become evident upon reading the following detailed description.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Figure 1:
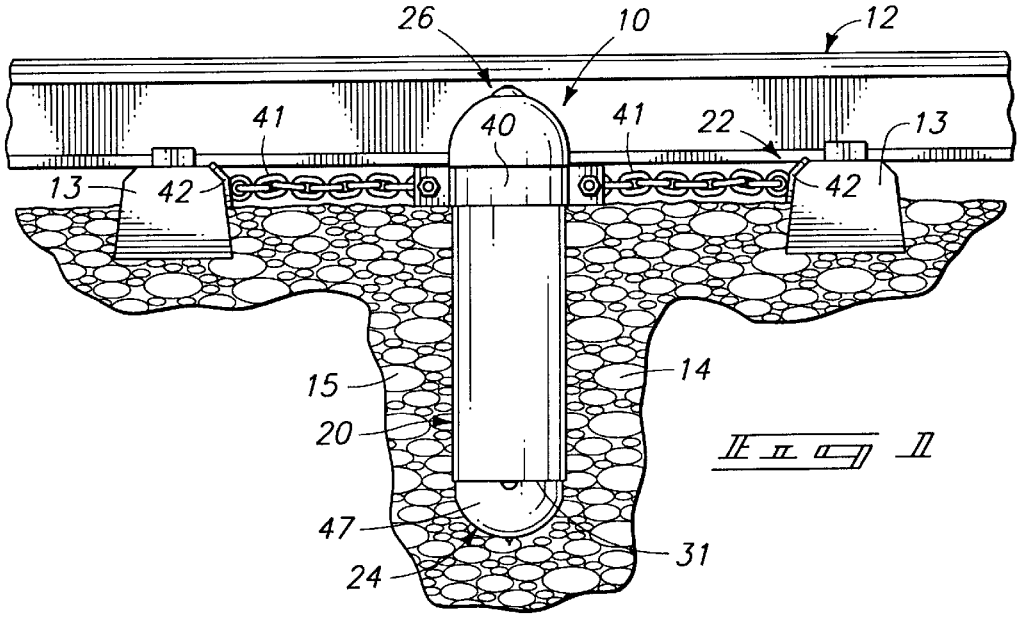
FIG. 1 is a schematic view showing a first preferred form of the present sensing device mounted in relation to railroad tracks and adjacent ballast.

This disclosure of the invention is submitted in furtherance of the constitutional Ures of the U.S. Patent Laws "to promote the progress of science and useful arts" (Article 1, Section 8).

A preferred form of sensing device is generally indicated by the reference numeral 10 in the drawings. The device 10 is intended for use to sense relative movement between two adjacent elements, one of which has a potential for movement relative to the other. The device may be mounted to one of the elements and in contact with the other, with components of the device functioning in such a manner that movement of either element will result in a signal being produced.

For ease in further description herein the term "structure" should be understood as an element such as a railroad tie, rail, paved road surface, or other substantially stationary above ground construction. The term "earthen material" is also given broad meaning as the remaining element, including any flowable particulate material that supports, surrounds, or buttresses the structure. Movable rock, gravel, sand, soil, snow, ice, or similarly flowable materials or combinations thereof are herein considered "earthen materials".

EMBODIMENTS IN GENERAL

Figure 2:
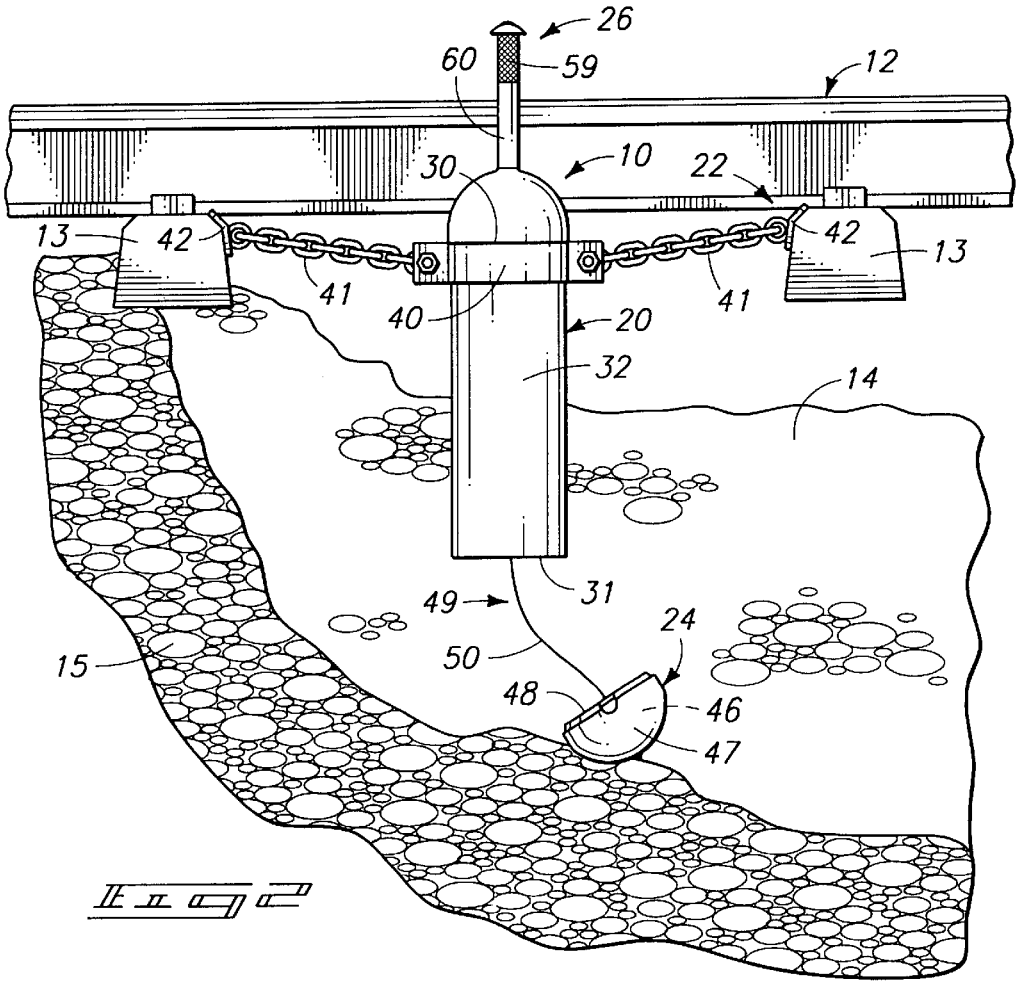
FIG. 2 is a view similar to FIG. 1 only showing the ballast shifted and the preferred sensing device in an operative condition responsive to the ballast shift.
Figure 3:
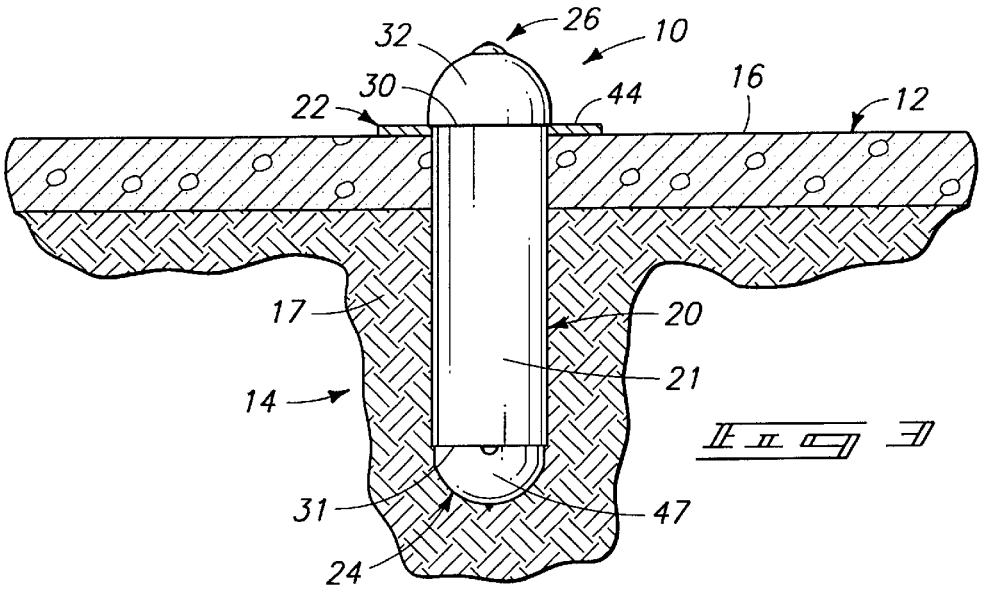
FIG. 3 is a schematic view showing a first preferred form of the present sensing device mounted in relation to a roadway surface and earthen material.
Figure 4:
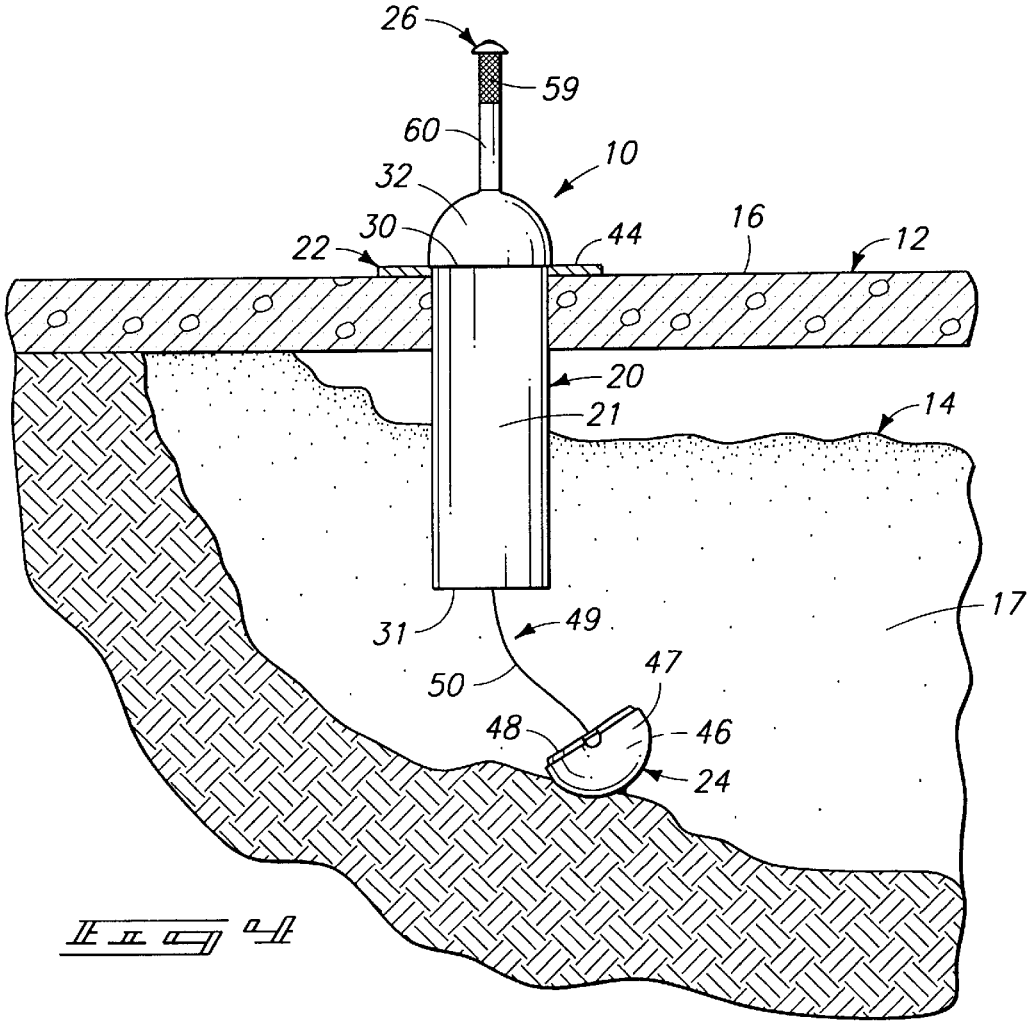
FIG. 4 is a view similar to FIG. 3 only showing the ballast shifted and the preferred sensing device in an operative condition responsive to the ballast shift.

In the illustrated examples, the present device 10 is used between structure 12 such as railroad ties 13 and adjacent earthen materials 14 formed of support ballast 15 (FIGS. 1, 2). In FIGS. 3 and 4, the structure 12 is a roadway surface 16 and the earthen material 14 is an adjacent roadbed 17.

A preferred device 10 is shown by way of example in FIGS. 1 and 2 mounted in relation to railroad ties 13 and ballast 15. The device 10 is suspended from the ties 13 and contacts the ballast 15. Shifting of the ballast 15 as shown in FIG. 2 results in a signal being produced. In FIG. 3, another preferred form of the device 10 is shown supported by a roadway surface 16 (such as concrete, asphalt or other paving), and in contact with the roadbed 17 below. FIG. 4 illustrates a shift between the roadway surface 16 and roadbed 17 and the resulting signal produced by the device 10.

Applications in addition to those shown and described herein may involve other structures. As a still further example, the present device could be connected to a bridge abutment and be placed in contact with adjacent ground. Movement of either the ground surface or the bridge abutment could trigger the device.

Referring in general terms to preferred components of the device 10, attention is directed to the embodiments of FIGS. 1–3. The embodiments include a frame 20 that may be suspended or otherwise secured to a support surface by an anchor 22. In FIGS. 1 and 2, the anchor 22 includes an anchor 22 configured to suspend the frame from the railroad ties 13. A alternate version of the anchor 22 is shown in FIGS. 3 and 4 and will be described in greater detail below.

An actuator 24 on the frame 20 is configured to rest against the earthen material and is movable between an inoperative position (FIGS. 1, 3) and an operative position (FIGS. 2, 4). Such movement is responsive to movement of earthen material 14 relative to an adjacent structure 12.

A signaling device 26 is connected to the actuator 24 and is responsive to movement of the actuator 24 to the operative position to produce a signal. The signaling device 26 thus indicates movement of the earthen material 14.

SPECIFIC ELEMENTS

The Frame 20

Figure 5:
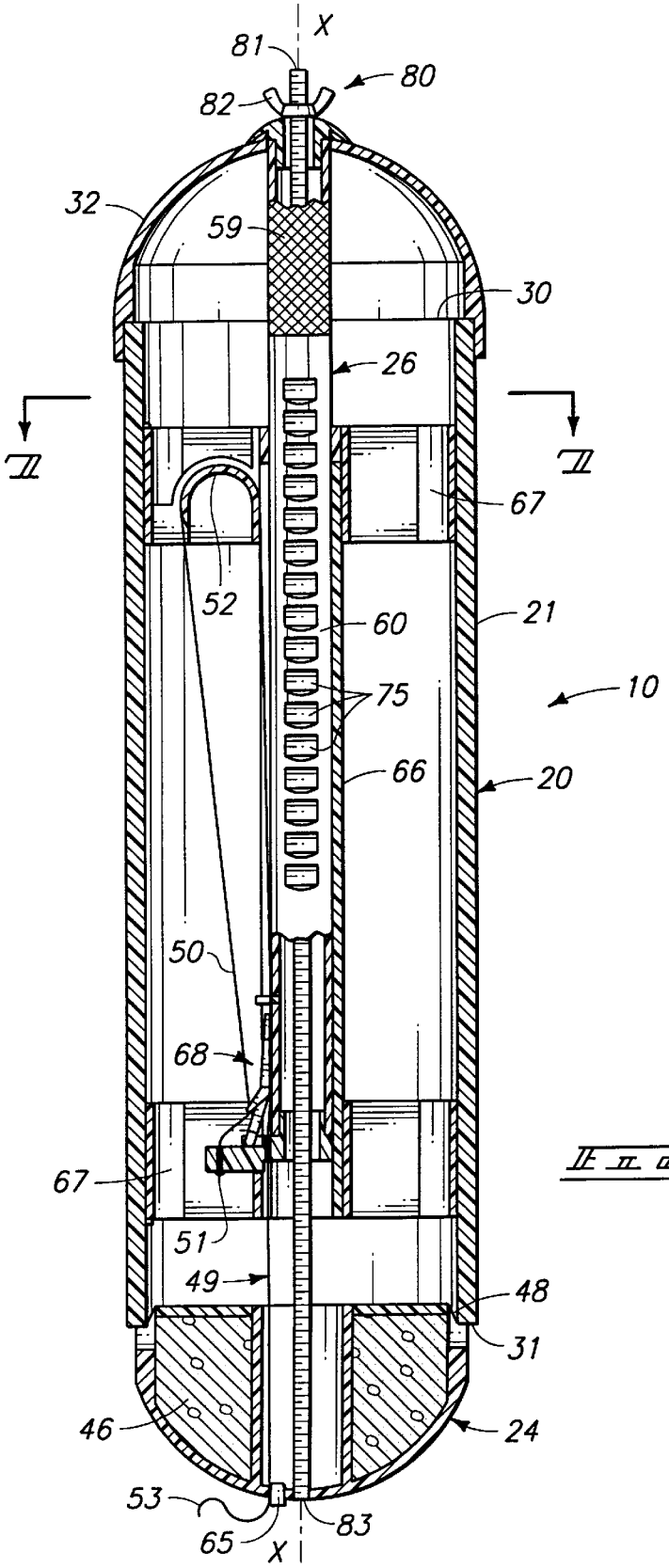
FIG. 5 is a partially fragmented sectional view through a preferred device.

Referring in greater detail to the frame 20, reference is made in particular to FIG. 5 of the drawings. The frame 20 is preferably formed as a tubular member 21 extending from a top 30 to an open bottom end 31. It is preferred that the tubular member 21 be formed of a rigid material that is durable and corrosion resistant, such as injection molded polyethylene. The overall length of the tubular member 21 along its central longitudinal axis X may vary according to particular situations. It is desirable that the tubular member 21 be substantially rigid and self-supporting along its length to protect the components held inside from damage by adjacent earthen materials and possible harsh environment.

The top 30 of the tubular frame member 21 is advantageously provided with a top cover 32. The top cover 32 spans the top 30, protecting the tube interior components against accumulation of dirt, dust, water, snow or vandalism from above. In a preferred form, the top cover 32 includes a top central opening that slidably accommodates a portion of the signaling device 26. It is also preferred that the top cover 32 be formed of the same material as the tubular frame.

The Anchor 22

The anchor 22 is configured to mount the frame to the structure 12 with the bottom end resting against the earthen materials 14. In the embodiment shown in FIGS. 1 and 2, the anchor is preferably comprised of a collar 40 secured to the frame 20 adjacent the top end 30, and a pair of flexible members such as chains 41 extending from the collar to brackets 42. The brackets 42 are configured to be secured by conventional means such as adhesives, mechanical fasteners or other appropriate attachment, to the structure 12.

It is pointed out that the structure of the collar, brackets and flexible members may vary in configuration, depending upon the structure and surrounding environment. In the illustrated environment exemplified in FIGS. 1 and 2, the chains 41 extend to opposite sides of the frame 20 and the brackets 42 are mounted to two adjacent ties in such a manner that the frame, if not otherwise supported, would be suspended between the ties at a selected elevation in relation to the surrounding ballast 15.

It is desirable to partially bury the frame in the ballast 15 or other adjacent earthen materials 14 to secure the frame against motion that could otherwise produce a false signal. To further avoid a false signal, the chain length is adjusted to allow slight relative motion of the ties as expected under normal train traffic or weather conditions.

The anchor 22 in the embodiment shown by FIGS. 3 and 4 is comprised of a flange 44 mounted to the frame 20 adjacent the top end 30. The flange 44 extends outwardly of the frame 20 to provide abutment surfaces for supporting the device on the adjacent roadway surface 16. In situations where visibility of the signaling device is desired, the flange 44 is situated along the frame in such a manner that the top cover 32 is exposed at or above the roadway surface 16. The remainder of the frame length extends downwardly through the thickness of the roadway surface 16 to locate the actuator in a position resting against the roadbed 17 as shown in FIG. 3.

The Actuator 24

It is preferred that the actuator 24 include a weighted mass 46 releasably attached to the open bottom end 31 of the tubular frame. It is advantageous that the mass 46 be contained within a bottom cover 47 that is releasably attached to and spans the open bottom end of the frame when in the inoperative position. The mass may be poured concrete, a metal weight, or another suitable heavy mass, partially or completely filling the bottom cover 47. Concrete has been found useful since it may be poured into the cover and will harden in the shape of the cover interior. The bottom cover 47 is preferably formed of the same material as the tubular member 21 and is hollow to receive the weighted mass 46. The fit between the bottom cover 47 and the tubular member is such that the actuator is capable of dropping away from the tubular member by force of gravity. To accomplish such a slidable connection, the bottom cover advantageously includes an upper boss 48 which forms a joint with the bottom end of the tubular housing 21. The boss 48 is similar in cross section to the internal wall configuration of the tubular member, but of a reduced size to loosely fit into the open bottom end 31.

The boss 48 will normally be received within and form a loose joint with the open bottom end of the tubular member but will slip easily from such engagement in response to movement of the adjacent earthen materials. This situation will occur when the supportive earthen materials shift sufficiently to (a) allow the actuator to drop, or (b) move the actuator laterally from engagement with the bottom open end 31. A link 49 extends between the weighted mass and the signaling device. FIGS. 2, 4, and 5 show a preferred form of the link 49 including a length of flexible actuator strand 50 that extends between the signalling device 26 and the actuator 24. The strand 50 may be a strong plastic line, of the type commonly used in sport fishing, or another similarly strong, flexible filament that will resist corrosion and temperature extremes.

In a preferred arrangement, the strand 50 extends from an end 51 connected to the signalling device, over a smooth surfaced guide 52 that is situated above the end 51 and that is mounted to the frame 20. The strand slidably engages the guide then extends on downwardly to the end 53 that is connected to the actuator 24.

It is advantageous to provide a strand length adjustment 65 releasably securing the actuator strand 50 to the actuator 24. The exemplified adjustment may be comprised of a simple plug or wedge as shown or another equivalent arrangement such as a set screw, releasably received within an aperture formed in the actuator to clamp against and fix the strand 50 to the actuator.

Movement of the actuator relative to the frame will result in corresponding movement of the strand over the guide 52 and actuate the signalling device to shift to the operative position.

Signaling Device 26

In a first preferred form, the signaling device 26 is comprised of a standard 60 mounted to the frame and movable relative to the frame from (a) an inoperative visually obscure position (FIGS. 1, 3 and 5) in which the standard 60 is encased within the tubular member 21; and (b) an operative, visually exposed signal position (FIGS. 2, 4). Movement of the standard 60 from the inoperative to the operative position is automatic and directly responsive to movement of the actuator 24 from the inoperative position to the operative position.

In the signal position, the standard 60 projects from the top end of the tubular member, with a top end clearly visible.

In preferred forms, the standard 60 is a rod or tubular member with the top end having a visually reflective surface 59. The top end is capped to span the top central opening of the cover when the standard is inoperative.

The length of the standard 60 is such that the top end will project to a clearly visible location in the operative position. This is shown in FIG. 2 where the reflective surface 59 is shown clear of the railroad rails. The reflective surface 59 will thus be easily visible from a considerable distance.

The signaling device 26 may also be comprised of an electrical switch 61, positioned within the tubular member and operative to close or open (depending upon the desired application and any electrically connected warning apparatus) upon movement of the actuator to the operative position. It is noted that the switch 61 is shown in conjunction with the standard 60, so that both are representative of the signalling device. However it is also possible to provide the present device with one or the other (the standard or switch). With the standard 60 alone, only a visual signal will be provided. With the switch 61 alone, only an electrical signal is produced. It is preferred, however, that both signalling forms be used as shown, so a visual and an electrical signal may be produced in response to movement of the actuator 24.

Figure 8:
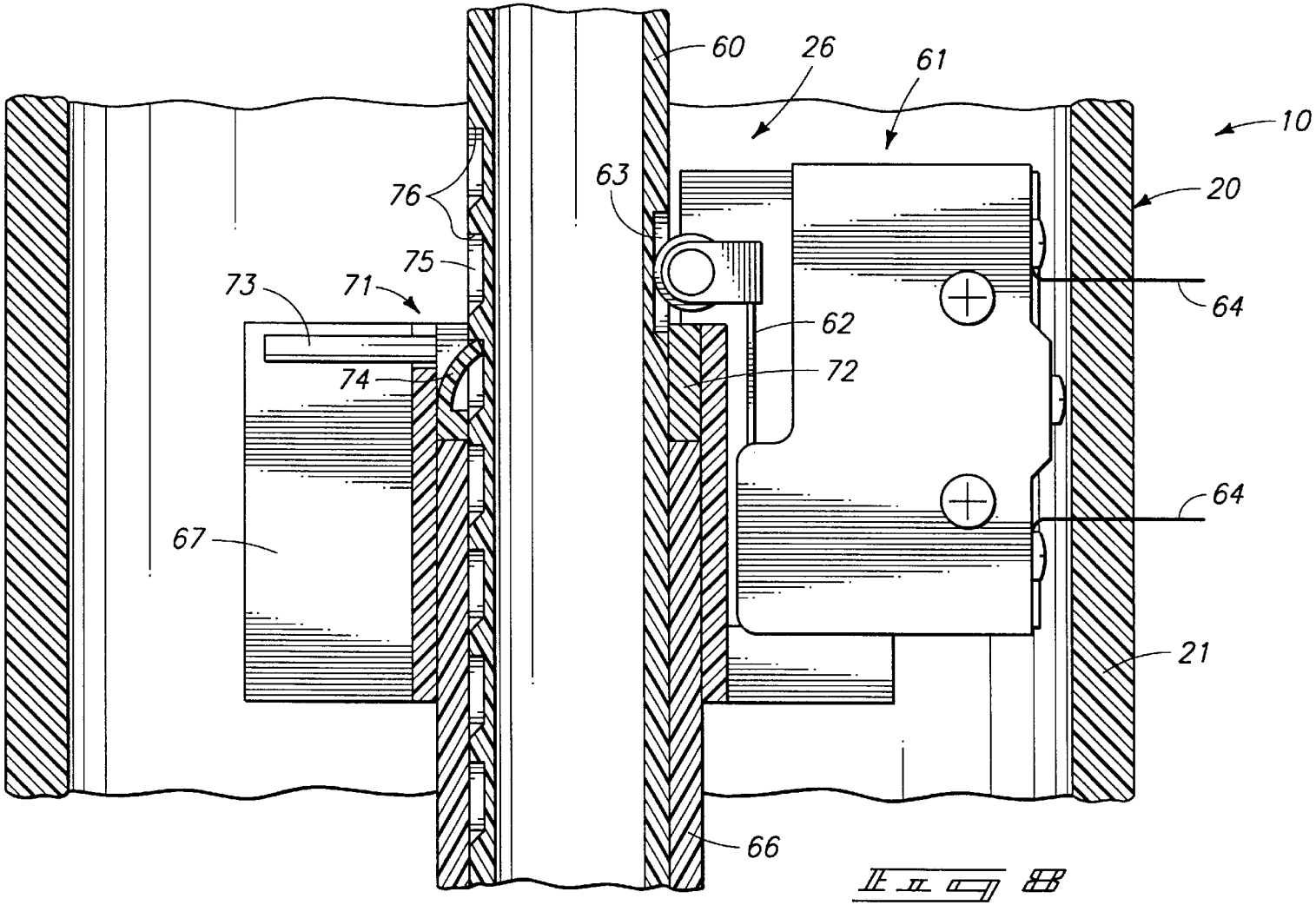
FIG. 8 is a further enlarged fragmented view taken substantially along line 8—8 in FIG. 7.

The preferred switch 61 illustrated in FIG. 8 is a conventional limit switch, selected for reliable operation in extreme conditions. The switch includes an operator 62 that is positioned adjacent a cam surface 63 on the standard 60. As the standard 60 moves upwardly, the cam surface 63 will move against the operator 62 and activate the switch. Appropriate electrical connectors 64 extend from the switch for attachment to an electrically operable warning device (not shown) that may be provided at the installation site or at a remote location.

Figure 9:
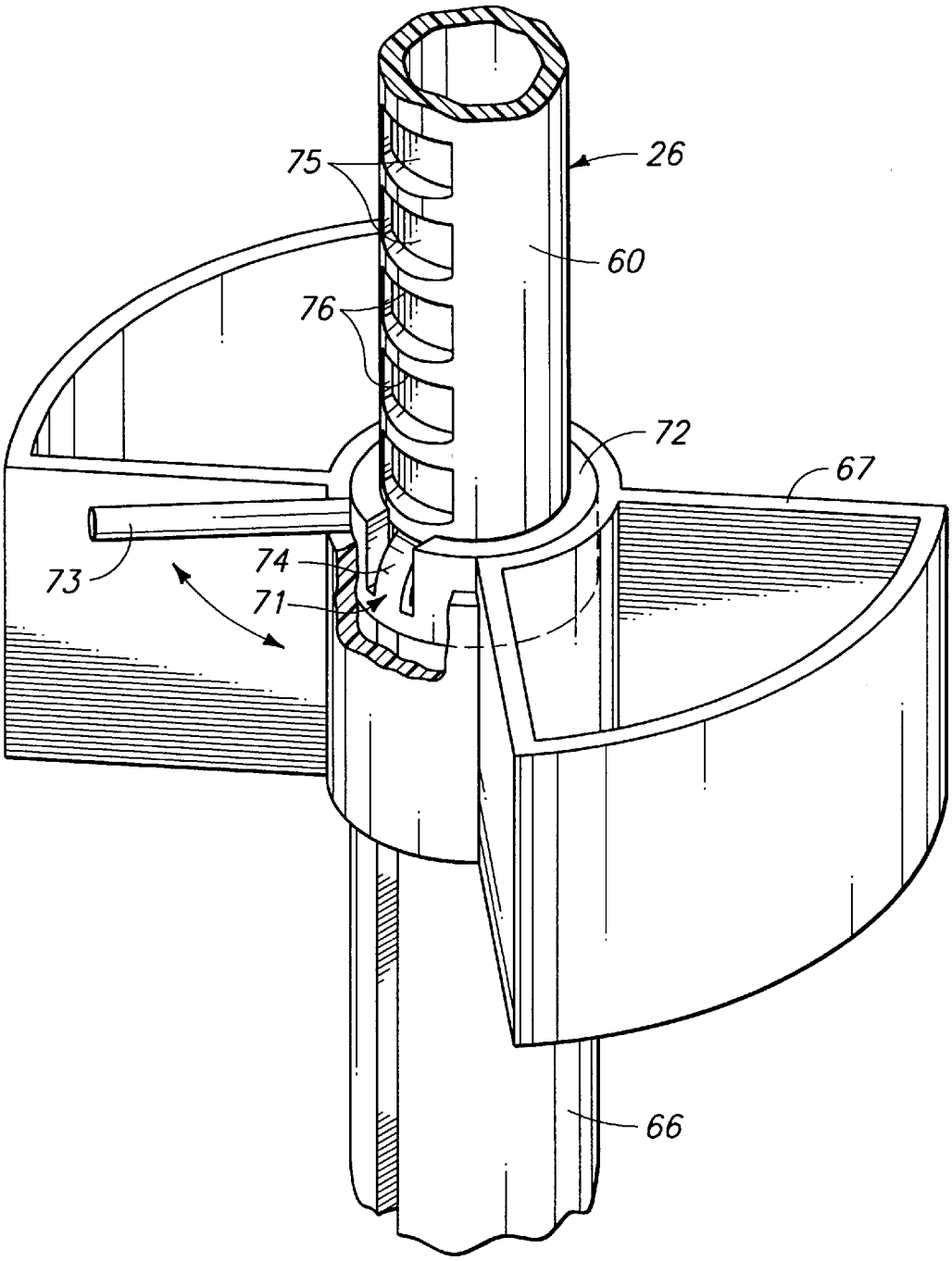
FIG. 9 is a fragmented perspective view of a preferred lockout device.
Figure 10:
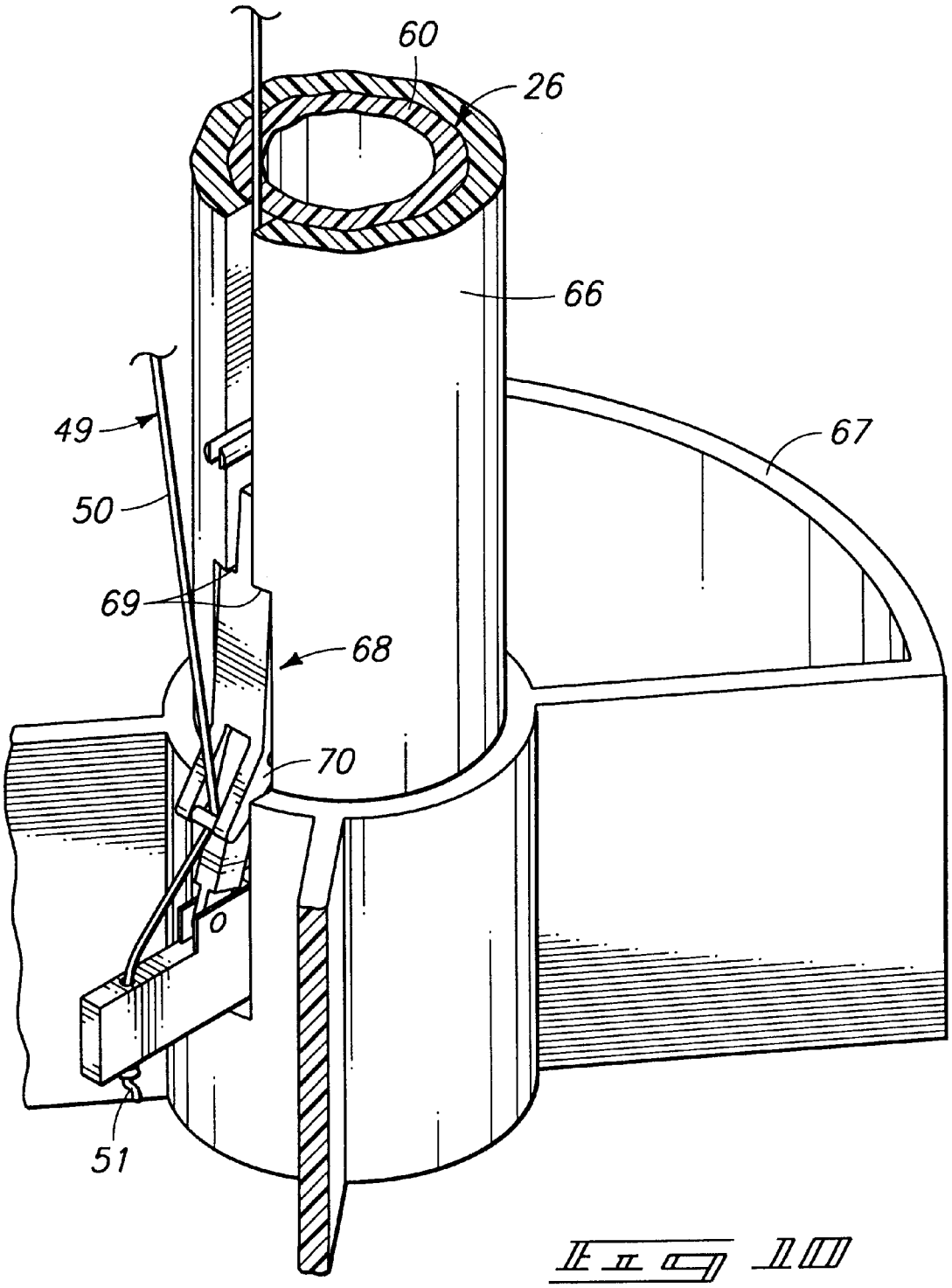
FIG. 10 is a fragmented perspective view of a latching mechanism used to releasably hold a signaling device in an inoperative position.
Figure 11:
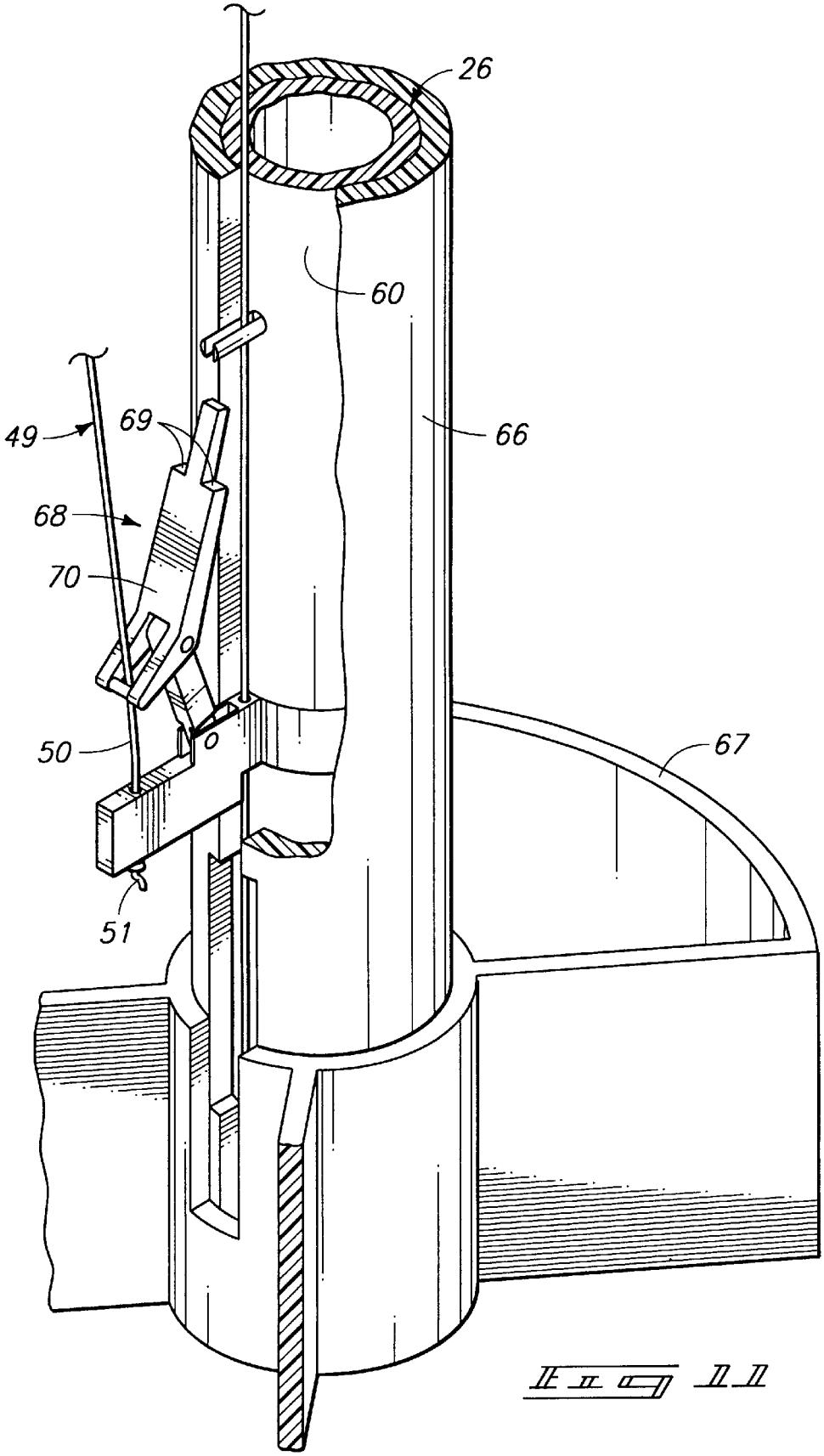
FIG. 11 is a fragmented perspective view of the latching mechanism in a released position and the signaling device shifted toward an operative position.

Referring in greater detail to FIGS. 7–11, further exemplary aspects of the preferred signalling device and adjacent structure are shown. FIGS. 9, 10 and 11 show the standard 60 slidably positioned at a central location within the tubular frame member 21 by a central, longitudinally slotted sleeve 66 that is secured within the tubular member by spaced hubs 67. The sleeve 66 is slotted to slidably receive a latch device 68 that is mounted to the standard 60 and is operable to latch the standard down in its inoperative, encased position (FIG. 5).

An exemplary form of a latch device 68 is shown in FIGS. 10 and 11. FIG. 10 shows the latch device 68 in an operative position, holding the standard in the retracted, inoperative position. FIG. 11 shows the latch device 68 in an inoperative position, allowing the standard 60 to be lifted to its extended, operative position.

A comparison of FIGS. 10 and 11 may be made to best understand operation of the latch device 68. In FIG. 10, the device 68 is flexed inwardly, with shoulders 69 engaged with complementary shoulders formed in the guide sleeve 66. The strand 50 is threaded through a linkage part 70 of the latch device 68. The strand end 51 is attached at a point radially outward of the linkage part 70. Tension along the strand, caused by movement of the actuator 24, will snap the linkage part 70 of the latching device 68 over-center to a release position (FIG. 11) thereby freeing the standard to be pulled upwardly by the actuator 24.

The latched position is a "normal" position in which the standard is held against upward axial movement. Thus the standard cannot be easily lifted from above simply by pulling upwardly on the capped standard top. Instead, as preferred for proper operation, only downward or lateral motion of the actuator (as will occur when the supportive earthen materials 14 shifts) will cause upward motion of the standard.

Figure 6:
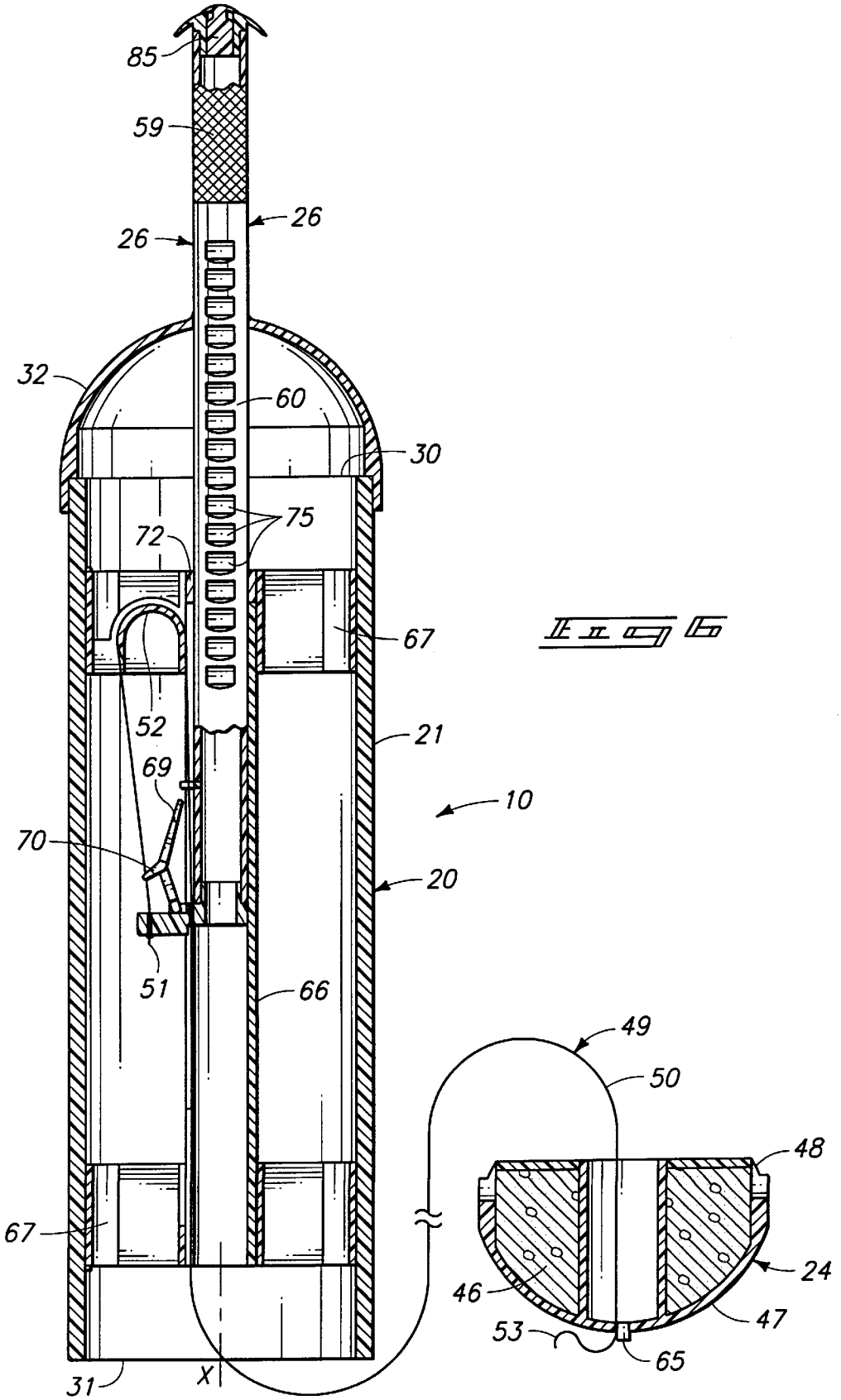
FIG. 6 is a view similar to FIG. 5 only showing the device in an operative mode.
Figure 7:
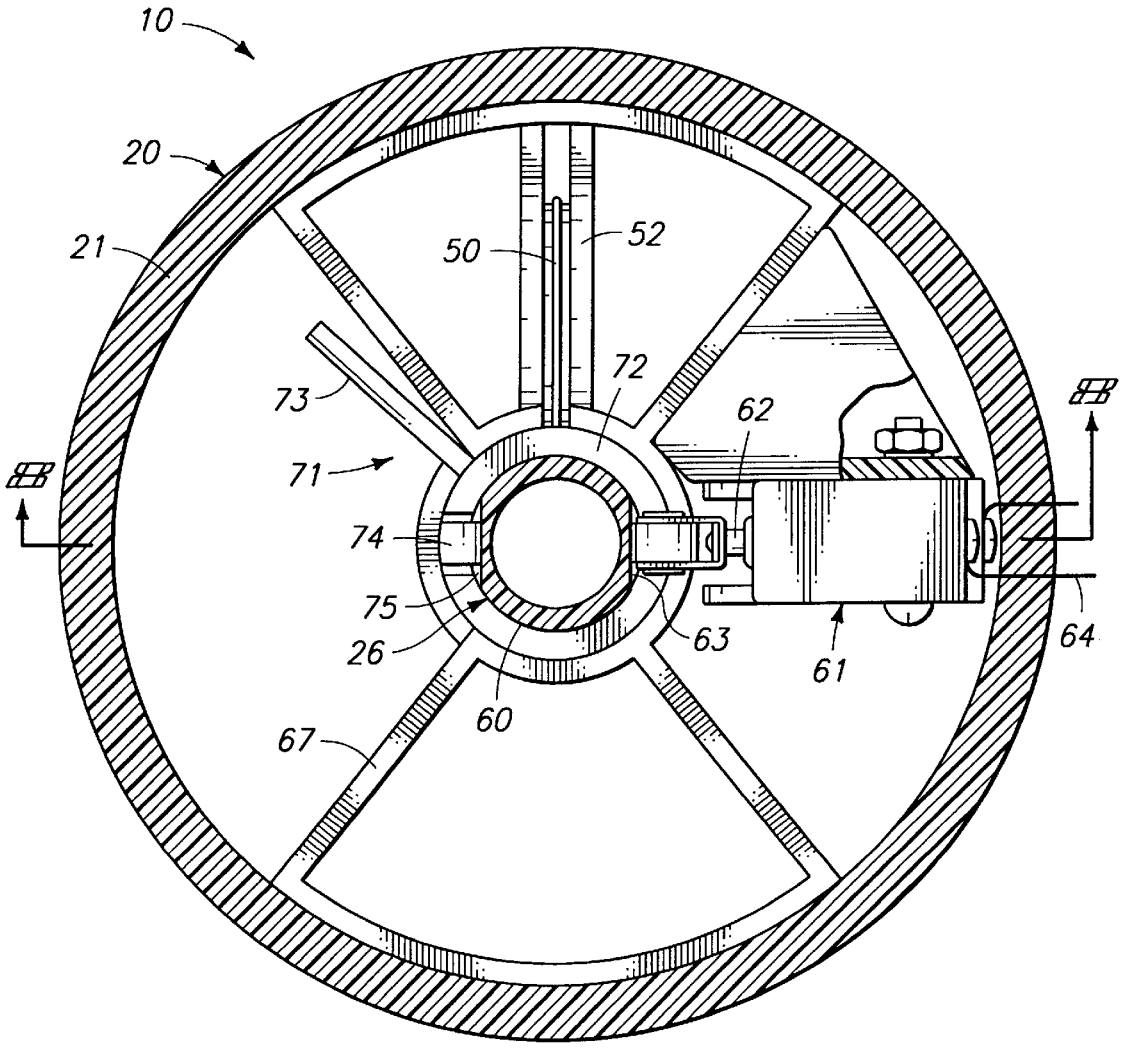
FIG. 7 is an enlarged transverse partially fragmented cross sectional view taken substantially along line 7—7 in FIG. 5.

Also provided in preferred forms is a lockout device 71 that interconnects the standard 60 and the frame 20. The lockout device 71 is configured to lock the standard in the signal position (FIG. 6). Referring to FIG. 7, the lockout device can be seen to include a collar 72 fitted around the standard, with a lever 73 extending outwardly therefrom. The lever 73 provides finger access to enable rotational shifting of the collar about the axis of the standard 60. A spring pawl 74 is provided on the collar and is normally biased radially inwardly to be received between successive ratchet teeth 75 that are spaced axially along the standard 60.

The pawl 74 is oriented to allow the standard to move relatively freely to the operative signalling position, but will resist (by abutment with flats 76 on the ratchet teeth 75) reverse or downward motion of the standard. The standard 60 is thus held against being pushed back down once it has been lifted in response to movement of the actuator 24. A turn of the lever 73 (once access is gained through the top cover) will rotate the pawl 74 from engagement with the ratchet teeth and allow the standard to be pushed back down to the lowered, inoperative position.

Other Provisions

It is preferred that the device be prepared in an assembled condition, ready for installation. To accomplish this, a retainer 80 is provided, releasably securing the actuator 24 to the tubular frame member 21. The retainer may be provided in the form of an elongated shaft 81 with a knob 82 at a top end and a bottom threaded end 83 that is threadably received within a similarly threaded socket in the actuator 24. The shaft 81 is sufficiently long to extend through the capped top of the standard, downwardly through the standard and into the actuator. The knob may be turned to thread the shaft into the actuator and effectively clamp the actuator to the frame. This is done during assembly so the complete device 10 may be installed on site with the actuator firmly in place against the bottom of the tubular frame. Then, following installation, the retainer may be removed by turning the knob 82 to disengage the shaft 81 from the actuator and then pulling the shaft upwardly from the device. A plug 85 (FIG. 6) may then be placed in the hole at the capped top of the standard.

Once the retainer 80 is removed from the device 10, the actuator 24 is free to remain at rest against the underlying earthen materials 14, or to move with the materials 14 should they shift for any reason. Removal of the retainer thus "arms" the device for operation.

Process

The device 10 is used in the presently preferred process for indicating movement of earthen materials 14 relative to a structure 12 supported by the earthen material 14. Within the preferred process, installation of the device includes the following steps.

A preliminary step involves attaching anchor 22 to the structure 12. Such attachment is accomplished using the collar 40, chains 41 and brackets 42, or the flange 44 depending upon the nature of the structure 12. It is preferred that the collar 40, chains 41 and brackets 42 be used in a manner similar to the showing in FIG. 1 when the structure is railway tracks. The flange 44 is preferably used to secure the device relative to a structure 12 such as a roadway surface 16 in a manner similar to the showing in FIG. 3. It may also be desirable to prepare the adjacent earthen materials 14 by boring or otherwise preparing an opening to a depth similar to the length of the tubular frame member and actuator 24 below the collar 40 or flange 44.

Another preferred step involves supporting an earthen material integrity sensing device 10 from the anchor 22, with the actuator 24 resting against the earthen material 14 and wherein the actuator is movable between the inoperative and operative positions in response to movement of the earthen material 14 relative to the structure 12. This is done as the device is lowered into the prepared bore hole or recess. Alternatively, the device is supported using the anchor 22 in such a manner that the actuator will rest against the surface of the earthen materials.

At this point, a further step involves releasing the retainer 80 to enable movement of the actuator to the operative position. This is accomplished as described above, by turning the knob 82 to loosen the shaft 81, then pulling the shaft free of the device 10. The plug 85 may then be placed and the device is ready for operation.

The final step involves the signaling device 26 responding to movement of the actuator 24 to the operative position to produce a signal indicating movement of the earthen material 14 relative to the structure 12.

Operation

Operation of the device 10 occurs as the earthen material 12 presently supporting the actuator 24 moves relative to the structure 12 to which the device is mounted. As the earthen material 12 shifts, (drops away or moves laterally) the actuator 24 is carried along with the shifting materials. The actuator moves away from the tubular frame which is attached to the structure 12 and thus pulls against the strand 50.

As tension along the strand 50 builds, the latch device 68 will snap to the unlatched position (FIG. 11) and allow the strand to pull the standard 60 upwardly, thus visually signalling (by way of the presently visible reflective surface 59) that the earthen materials have shifted. Also or alternatively, the cam surface on the standard will operate the switch 61, which may be electrically connected to an appropriate warning device (not shown) which will provide warning of the shifted earthen materials. The warning provided may enable preventative actions to be taken to avoid serious accidents or disasters.

Shifting of the adjacent earthen materials may be the result of many different conditions. Flooding, for example will often wash away railway ballast or roadbed, leaving the adjacent structure basically unsupported and too weak to support traffic. The present device, placed at areas where such a disturbance could occur, will provide a warning that the shift of underlying earthen materials has occurred.

The device will also warn of movement of the structure relative to the earthen materials. For example, should the railway or roadway surface buckle from heat or other adverse condition, such movement will result in motion of the tubular frame (being mounted to the structure) relative to the actuator, and the signalling device will shift to the operative position.

As a further example, the present device 10 may be secured to a structure such as a bridge abutment with the actuator resting against the adjacent supportive earthen materials. Movement of the abutment, caused by impact by a moving conveyance will shift the tubular frame 20 relative to the earthen materials and cause operation of the signalling device substantially as described above. Likewise, shifting of the earthen materials (as caused for example by washout, erosion, landslide, or earthquake) will also actuate the device to provide a warning, even if the abutment remains stationary.

Of course similar situations could occur with the present device mounted to a building foundation or any other structure that is intended to remain stationary relative to adjacent earthen materials.

Thus, in compliance with the statute, the invention has been described in language more or less specific as to structural and methodical features. It is to be understood, however, that the invention is not limited to the specific features shown and described, since the elements herein disclosed comprise preferred forms of putting the invention into effect. The invention is, therefore, claimed in any of its forms or modifications within the scope of the appended claims appropriately interpreted in accordance with the doctrine of equivalents.

What is claimed is:

1. An earthen material integrity sensing device for indicating movement of earthen material relative to a structure supported by the earthen material, comprising:

a frame adapted to be secured to the structure;

an actuator on the frame configured to rest against the earthen material and movable between an inoperative position and an operative position responsive to movement of the earthen material relative to the structure;

a signaling device connected to the actuator and responsive to movement of the actuator to the operative position to produce a signal indicating movement of the earthen material relative to the structure; and a retainer releasably securing the actuator and the frame, and detachable from at least one of the actuator and frame to allow movement of the actuator to the operative position.

2. The earthen material integrity sensing device for indicating movement of earthen material relative to a structure supported by the earthen material, as defined by claim 1 wherein the actuator is comprised of a weighted mass.

3. The earthen material integrity sensing device for indicating movement of earthen material relative to a structure supported by the earthen material, as defined by claim 1 wherein the actuator is comprised of a weighted mass and further comprising a link extending between the weighted mass and the signaling device.

4. The earthen material integrity sensing device for indicating movement of earthen material relative to a structure supported by the earthen material, as defined by claim 1 wherein:

the frame is comprised of a tubular member having a top and an open bottom end;

the actuator is comprised of a weighted mass configured to span and close the open bottom end of the frame; and a joint between the actuator and tubular member releasably connecting the actuator and the frame.

5. The earthen material integrity sensing device for indicating movement of earthen material relative to a structure supported by the earthen material, as defined by claim 1 wherein the signaling device is comprised of a standard mounted to the frame and movable relative to the frame from an inoperative position to a visually exposed signal position in response to movement of the actuator from the inoperative position to the operative position.

6. The earthen material integrity sensing device for indicating movement of earthen material relative to a structure supported by the earthen material, as defined by claim 1 wherein the signaling device is comprised of a standard mounted to the frame and movable relative to the frame from an inoperative position to a visually exposed signal position in response to movement of the actuator from the inoperative position to the operative position; and further comprising a lockout device interconnecting the standard and the frame and configured to lock the standard in the signal position.

7. The earthen material integrity sensing device for indicating movement of earthen material relative to a structure supported by the earthen material, as defined by claim 1 wherein:

the frame is comprised of a tubular member having a top and an open bottom end spaced apart along a central longitudinal axis; and the signaling device is comprised of a standard slidably mounted to the frame for axial movement between an encased visually obscure position within the tubular member and an axially disposed position projecting from the top end of the tubular member.

8. The earthen material integrity sensing device for indicating movement of earthen material relative to a structure supported by the earthen material, as defined by claim 1 wherein:

the frame is comprised of a tubular member having a top and an open bottom end spaced apart along a central longitudinal axis; and the frame further includes a top cover at the top end of the tubular member spanning the top;

the actuator is comprised of a weighted mass formed as a bottom cover releasably spanning the open bottom end of the tubular member; and the signaling device is mounted within the tubular member.

9. A sensing device for indicating movement of earthen material adjacent a structure, comprising:

a tubular frame including a top end and a bottom end;

an anchor configured to suspend the frame from the structure with the bottom end oriented toward the earthen material;

an actuator releasably mounted on the bottom end of the tubular frame, spanning the bottom end and configured to rest against and be supported by the earthen material;

wherein the actuator is movable in response to movement of the earthen material relative to the structure from an inoperative position engaging and spanning the bottom end of the tubular frame to an operative position spaced from the inoperative position;

a signaling device mounted within the tubular frame and connected to the actuator;

wherein the signaling device is responsive to movement of the actuator to the operative position to produce a signal indicating movement of the earthen material relative to the structure; and a retainer releasably securing the actuator to the tubular frame.

10. The sensing device as defined by claim 9 wherein the retainer is comprised of an elongated rod having one end releasably secured to the actuator and a remaining end releasably secured to the tubular frame adjacent the top end, and an operator at the remaining end of the rod enabling manual detachment of the rod from the actuator to permit movement of the actuator to the operative position.

11. The sensing device as defined by claim 9 wherein the actuator is comprised of a weighted mass formed as a bottom cover releasably spanning the bottom end of the tubular frame.

12. The sensing device as defined by claim 9 wherein the actuator is comprised of a weighted mass formed as a bottom cover releasably attached to and spanning the bottom end of the tubular frame, the releasable attachment being such that the weighted mass is capable of moving away from the tubular frame.

13. The sensing device as defined by claim 9 wherein the actuator is connected to the signaling device by a flexible actuator strand and further comprising a strand length adjustment releasably securing the actuator strand to the actuator.

14. The sensing device as defined by claim 9 wherein the signaling device is comprised of a standard mounted within the tubular frame and movable along an axis relative to the tubular frame from an inoperative position in which the standard is enclosed within the tubular frame to a visually exposed signal position in response to movement of the actuator from the inoperative position to the operative position.

15. The sensing device as defined by claim 9 wherein the signaling device is comprised of an electrical switch.

16. The sensing device as defined by claim 9 wherein the signaling device is comprised of:

a standard mounted within the tubular frame and movable along an axis relative to the tubular frame from an inoperative position in which the standard is enclosed within the tubular frame to a visually exposed signal position in response to movement of the actuator from the inoperative position to the operative position; and a lockout device within the tubular frame configured to permit movement of the standard to the visually exposed signal position and to inhibit motion of the standard from the visually exposed signal position to the inoperative position.

17. The sensing device as defined by claim 9 wherein the signaling device is comprised of:

a standard mounted within the tubular frame and movable along an axis relative to the tubular frame from an inoperative position in which the standard is enclosed within the tubular frame to a visually exposed signal position in response to movement of the actuator from the inoperative position to the operative position;

a lockout device within the tubular frame configured to permit movement of the standard to the visually exposed signal position and to inhibit motion of the standard from the visually exposed signal position to the inoperative position; and a lockout release on the tubular frame and selectively movable thereon to release the lockout device and permit motion of the standard from the visually exposed signal position to the inoperative position.

18. A process for indicating movement of earthen material relative to a structure supported by the earthen material, comprising the steps of:

attaching an anchor to the structure;

supporting an earthen material integrity sensing device from the anchor, the sensing device comprised of a frame with an actuator on the frame resting against the earthen material and wherein the actuator is movable between an inoperative position and an operative position in response to movement of the earthen material relative to the structure, and wherein the sensing device includes a signaling device connected to the actuator;

releasing a retainer that normally holds the actuator to the frame in the inoperative position, thereby allowing the actuator to move to the operative position upon movement of the earthen material; and said signaling device responding to movement of the actuator to the operative position to produce a signal indicating movement of the earthen material relative to the structure.

* * * * *

UNITED STATES PATENT AND TRADEMARK OFFICE

CERTIFICATE OF CORRECTION

PATENT NO. : 6,205,946 B1
DATED : March 27, 2001
INVENTOR(S) : Daniel R. Picton

It is certified that error appears in the above-identified patent and that said Letters Patent is hereby corrected as shown below:

Column 2,
Line 11, replace "Ures" with -- purposes --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*